US010478836B2

(12) United States Patent
Gao et al.

(10) Patent No.: US 10,478,836 B2
(45) Date of Patent: Nov. 19, 2019

(54) WATER OUTPUT DEVICE CAPABLE OF REGULATING WATER OUTPUT SPRAY

(71) Applicant: RUNNER (XIAMEN) CORP., Xiamen (CN)

(72) Inventors: Wen Gao, Xiamen (CN); Shun-Chuan Zheng, Xiamen (CN)

(73) Assignee: RUNNER (XIAMEN) CORP., Xiamen (CN)

( * ) Notice: Subject to any disclaimer, the term of this patent is extended or adjusted under 35 U.S.C. 154(b) by 56 days.

(21) Appl. No.: 15/827,819

(22) Filed: Nov. 30, 2017

(65) Prior Publication Data

US 2018/0161787 A1 Jun. 14, 2018

(30) Foreign Application Priority Data

Dec. 10, 2016 (CN) ..... 2016 2 1351787 U

(51) Int. Cl.

| | |
|---|---|
| ***B05B 1/18*** | (2006.01) |
| ***B05B 1/16*** | (2006.01) |
| ***E03C 1/04*** | (2006.01) |
| ***B05B 12/00*** | (2018.01) |
| ***B05B 3/04*** | (2006.01) |

(52) U.S. Cl.

CPC ..... *B05B 1/18* (2013.01); *B05B 1/16* (2013.01); *B05B 1/1636* (2013.01); *B05B 1/1654* (2013.01); *B05B 3/04* (2013.01); *B05B 12/00* (2013.01); *B05B 12/002* (2013.01); *E03C 1/0405* (2013.01)

(58) Field of Classification Search

CPC ... B05B 1/1636; B05B 1/1645; B05B 1/1654; B05B 1/18; B05B 12/002; E03C 1/0405

See application file for complete search history.

(56) References Cited

U.S. PATENT DOCUMENTS

| | | | | |
|---|---|---|---|---|
| 2008/0017735 | A1* | 1/2008 | Zhou | B05B 1/1636 239/437 |
| 2016/0184841 | A1* | 6/2016 | Lin | B05B 1/185 239/240 |
| 2016/0287034 | A1* | 10/2016 | Woodard | A47K 7/046 |
| 2016/0303587 | A1* | 10/2016 | Zhou | B05B 3/04 |

* cited by examiner

*Primary Examiner* — Ryan A Reis

(74) *Attorney, Agent, or Firm* — Chun-Ming Shih

(57) ABSTRACT

A water output device capable of regulating water output spray, comprising: an outer chamber; an inner chamber, disposed inside the outer chamber; an upper chamber, used to supply water to the inner chamber and the outer chamber; a water output panel, disposed on the outer chamber; a plurality of rotation panels, disposed evenly on the water output panel to form into a ring, on the respective rotation panels is provided with water output holes, and water is supplied to the rotation panel from the inner chamber; a driving mechanism, disposed in the inner chamber, to drive all the rotation panels into rotation synchronously; and a water channel switching mechanism, disposed in the upper chamber, to control switching of water supply to the inner chamber and the outer chamber, and when the water channel switching mechanism rotates, it brings the driving mechanism into rotation.

7 Claims, 7 Drawing Sheets

WATER OUTPUT DEVICE CAPABLE OF REGULATING WATER OUTPUT SPRAY

BACKGROUND OF THE INVENTION

Field of the Invention

The present invention relates to a water output device, and in particular to a water output device capable of regulating water output spray.

The Prior Arts

For the conventional shower head or top spray shower, when it is required to adjust the shower water ejection angle, the small water output panel is only capable of extending straight forward or retracting straight backward, such that the ejection angle can be adjusted is rather limited, while the appearance of the shower head varies markedly in the process.

Therefore, presently, the design and performance of the shower water output device is not quite satisfactory, and it leaves much room for improvement.

SUMMARY OF THE INVENTION

In view of the problems and drawbacks of the prior art, the present invention provides a water output device capable of regulating water output spray, to overcome the shortcomings of the prior art.

The present invention provides a water output device capable of regulating water output spray. For which, water can be ejected out slantwise in a shower water converging and diverging process, to realize water output spray by means of a rotation panel, while keeping the appearance of the shower head unchanged.

The present invention provides a water output device capable of regulating water output spray, that includes: an outer chamber, an inner chamber, an upper chamber, a water output panel, a plurality of rotation panels, a driving mechanism, and a water channel switching mechanism. The inner chamber is disposed inside the outer chamber. The upper chamber is used to supply water to the inner chamber and the outer chamber. The water output panel is disposed on the outer chamber. The plurality of rotation panels are disposed evenly on the water output panel to form into a ring; on the respective rotation panels is provided with slant water output holes, and water is supplied to the rotation panel from the inner chamber. The driving mechanism is disposed in the inner chamber, to drive all the rotation panels into rotation synchronously. The water channel switching mechanism is disposed in the upper chamber, to control switching of water supply to the inner chamber and the outer chamber, and when the water channel switching mechanism rotates, it brings the driving mechanism into rotation at the same time.

In an aspect of the present invention, the outer chamber is formed by the water output panel and an upper seat plate; the inner chamber is formed by a bottom seat and the upper seat plate; the upper chamber is formed by a water seal seat and the upper seat plate; in the inner chamber is disposed evenly a plurality of rotation shafts formed into a ring, in the respective rotation shaft is provided with a through hole; an upper end of the through hole is connected to and in communication with the inner chamber, a lower end of the through hole is connected to the rotation panel, to rotate synchronously with the rotation panel; the driving mechanism drives all the rotation shafts into rotation synchronously; in the upper chamber is provided with a first water input hole connected to and in communication with the inner chamber, and second water input hole connected to and in communication with the outer chamber; and the water channel switching mechanism is connected to a water supply pipe line, and when the water channel switching mechanism rotates, it controls and brings the first water input hole and the second water input hole to connect to and in communication respectively with the water supply pipe line.

In another aspect of the present invention, the water output hole is a straight hole, or a slant hole.

In yet another aspect of the present invention, the driving mechanism includes a sun gear disposed in a center of the inner chamber, and a planetary gear disposed fixedly on a side wall of the rotation shaft 8 engaging the sun gear.

In a further aspect of the present invention, the water channel switching mechanism includes a seal plate separating the upper chamber into an upper part and a lower part; on the seal plate is provided with a water passage hole; on a lower surface of the seal plate is provided with a lug penetrating through the upper chamber for controlling rotation of the sun gear; on an upper surface of the seal plate is provided with a water input tube; on a bottom portion of a side wall of the water input tube is provided with a water output port; an upper end of the water input tube penetrating through a water seal seat is connected to the water supply pipe line; while a driving lever is sleeved around an upper end of the water input tube, for driving the water input tube into rotation, such that when the driving lever is moved to drive the seal plate into rotation, the water passage hole is connected to and in communication with the first water input hole and the second water input hole in sequence.

In another aspect of the present invention, the water output device capable of regulating water output spray further includes: an upper cover, disposed above the driving lever; and a threaded pipe, disposed on the upper cover and is connected to and in communication with the water supply pipe line, and an input port of the water input tube is connected to the threaded pipe.

In yet another aspect of the present invention, the water output device capable of regulating water output spray further includes: a ring shape fixing frame, hinged to the rotation shaft, on the ring shape fixing frame is provided with a plurality of hinge holes having the same quantity as that of the rotation shaft.

In a further aspect of the present invention, the water output device capable of regulating water output spray further includes: a plurality of tight seal rings, disposed respectively between the water output panel and the upper seat plate, the bottom seat and the upper seat plate, the water seal seat and the upper seat plate, the lug and the upper seat plate, and around perimeters of the first water input hole and the second water input hole.

In yet another aspect of the present invention, the water output device capable of regulating water output spray further includes: a gag lever rod, disposed in a center at a bottom portion of the driving lever.

Compared with the existing technology, the present invention has the advantages in that, in the present invention, a sun gear is used to bring a plurality of planetary gears into rotation, to achieve slant angle shower water output spray in a convergent or divergent manner to meet different showering requirements of the users, while providing good showering feelings and experiences. As such, when the rotation panel is rotated to the water output straight hole, the showering water spray is able to achieve a massage effect, and when the rotation panel is rotated to the water output slant hole, the showering water spray can be regulated effectively to an ejection angle desired.

Further scope of the applicability of the present invention will become apparent from the detailed descriptions given hereinafter. However, it should be understood that the detailed descriptions and specific examples, while indicating preferred embodiments of the present invention, are given by way of illustration only, since various changes and modifications within the spirit and scope of the present invention will become apparent to those skilled in the art from the detailed descriptions.

BRIEF DESCRIPTION OF THE DRAWINGS

The related drawings in connection with the detailed descriptions of the present invention to be made later are described briefly as follows, in which.

DETAILED DESCRIPTION OF THE PREFERRED EMBODIMENT

Figure 1:
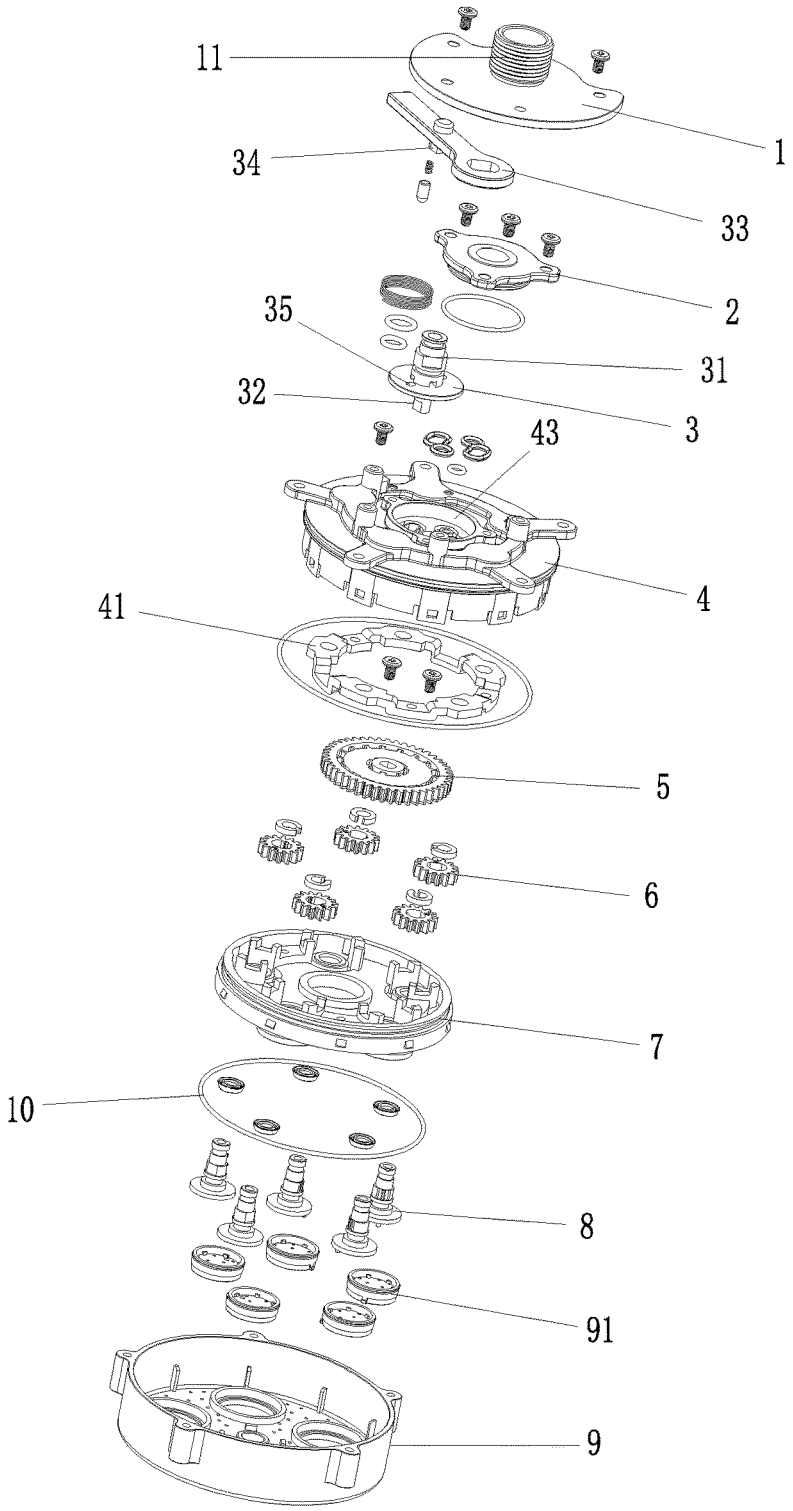
FIG. 1 is an exploded view of a water output device capable of regulating water output spray according to an embodiment of the present invention.

The purpose, construction, features, functions and advantages of the present invention can be appreciated and understood more thoroughly through the following detailed descriptions with reference to the attached drawings.

Refer to FIGS. 1 to 7 respectively for an exploded view of a water output device capable of regulating water output spray according to an embodiment of the present invention; a schematic diagram of a water output device capable of regulating water output spray, in which the water output panel is disposed for outputting water, according to an embodiment of the present invention; a schematic diagram of a water output device capable of regulating water output spray, in which the rotation panel is disposed for outputting water, according to an embodiment of the present invention; a schematic diagram of a water output device capable of regulating water output spray, in which water is output from the water output panel, according to an embodiment of the present invention; a schematic diagram of a water output device capable of regulating water output spray, in which water is output from the rotation panel, according to an embodiment of the present invention; a schematic diagram of a water output device capable of regulating water output spray, in which water is output convergently from the rotation panel, according to an embodiment of the present invention; and a schematic diagram of a rotation panel, in which the rotation panel is shown in different rotation states, according to an embodiment of the present invention.

As shown in FIGS. 1 to 7, The present invention provides a water output device capable of regulating water output spray, that includes: an outer chamber 94, an inner chamber, an upper chamber 43, a water output panel 9, a plurality of rotation panels 91, a driving mechanism, and a water channel switching mechanism. The outer chamber 94 is formed by the water output panel 9 and an upper seat plate 4. The inner chamber is disposed in the outer chamber 94, and is formed by a bottom seat 7 and the upper seat plate 4. The upper chamber 43 is formed by a water seal seat 2 and the upper seat plate 4. The plurality of rotation panels 91 are disposed evenly on the water output panel 9 to form into a ring, on the rotation panels 91 are each provided with a slant water output hole 93, all aligning in the same direction, and water is supplied to the rotation panel 91 from the inner chamber. On the water output panel 9 is provided with a plurality of water ejection holes 92, connected to and in communication with the outer chamber 94. In the inner chamber is disposed evenly a plurality of rotation shafts 8 formed into a ring, in the respective rotation shaft 8 is provided with a through hole. An upper end of the through hole is connected and in communication with the inner chamber, a lower end of the through hole is connected to the rotation panel 91, to rotate synchronously with the rotation panel 91. The driving mechanism is disposed in the inner chamber, to drive all the rotation shafts 8 into rotation synchronously. In the upper chamber 43 is provided with a first water input hole connected to and in communication with the inner chamber, and second water input hole connected to and in communication with the outer chamber 94. The water channel switching mechanism is disposed in the upper chamber 43, and is connected to the water supply pipe line. When the water channel switching mechanism rotates, it controls and brings the first water input hole and the second water input hole to connect to and in communication respectively with the water supply pipe line. When the water channel switching mechanism rotates, it brings the driving mechanism into rotation at the same time.

In an embodiment of the present invention, the driving mechanism includes a sun gear 5 disposed in a center of the inner chamber, and a planetary gear 6 disposed fixedly on a side wall of the rotation shaft 8 engaging the sun gear 5.

In an embodiment of the present invention, the water channel switching mechanism includes a seal plate 3 separating the upper chamber 43 into an upper part and a lower part; on the seal plate 3 is provided with a water passage hole 35; on a lower surface of the seal plate 3 is provided with a lug 32 penetrating through the upper chamber 43 for controlling rotation of the sun gear 5; on an upper surface of the seal plate 3 is provided with a water input tube; on a bottom portion of a side wall of the water input tube is provided with a water output port; an upper end of the water input tube penetrating through a water seal seat 2 is connected to the water supply pipe line; while a driving lever 33 is sleeved around an upper end of the water input tube, for driving the water input tube into rotation, such that when the driving lever 33 drives the seal plate 3 into rotation, the water passage hole 35 is connected to and in communication with the first water input hole and the second water input hole in sequence.

In an embodiment of the present invention, the water output device capable of regulating water output spray further includes: an upper cover 1, disposed above the driving lever 33; and a threaded pipe 11, disposed over the upper cover 1 and is connected to and in communication with the water supply pipe line, and input port of the water input tube is connected to the threaded pipe 11.

In an embodiment of the present invention, the water output device capable of regulating water output spray further includes: a ring shape fixing frame 41, hinged to the rotation shaft 8, on the ring shape fixing frame 41 is provided with a plurality of hinge holes having the same number as that of the rotation axis 8.

In an embodiment of the present invention, the water output device capable of regulating water output spray further includes: a plurality of tight seal rings 10, disposed respectively between the water output panel 9 and the upper seat plate 4, the bottom seat 7 and the upper seat plate 4, the water seal seat 2 and the upper seat plate 4, the lug 32 and the upper seat plate 4, and around perimeters of the first water input hole and the second water input hole.

In an embodiment of the present invention, the water output device capable of regulating water output spray further includes: a gag lever rod 34, disposed in a center at a bottom portion of the driving lever 33, to restrict the rotation angle of the driving lever 33.

In the present invention, the water output device capable of regulating water output spray can be implemented in the following steps:

(1) Firstly, placing the sun gear 5 in a position corresponding to that of the planetary gear 6, so that when the sun gear 5 rotates, it will bring the planetary gear 6 into rotation, so that all the slant water output holes 93 of the rotation panels 91 will turn in a direction from facing away from a straight line passing through the center of the water output panel 9 to a direction facing toward that line.

Figure 2:
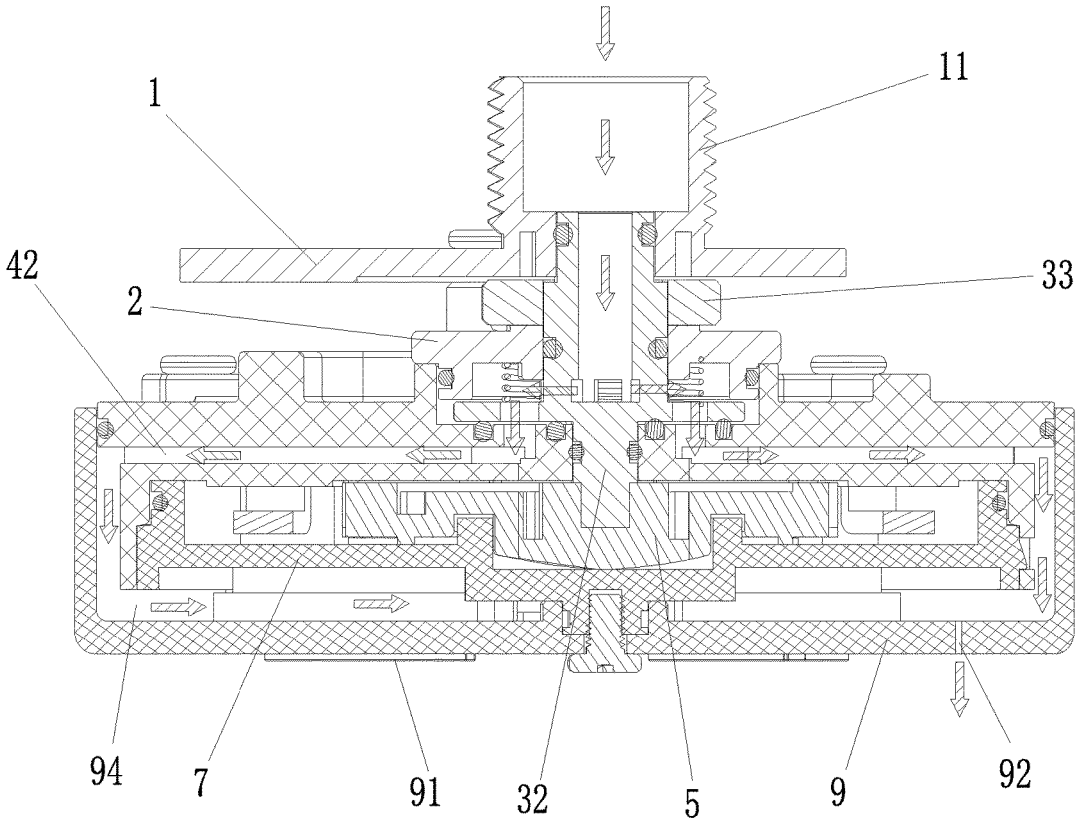
FIG. 2 is a schematic diagram of a water output device capable of regulating water output spray, in which the water output panel is disposed for outputting water, according to an embodiment of the present invention.
Figure 4:
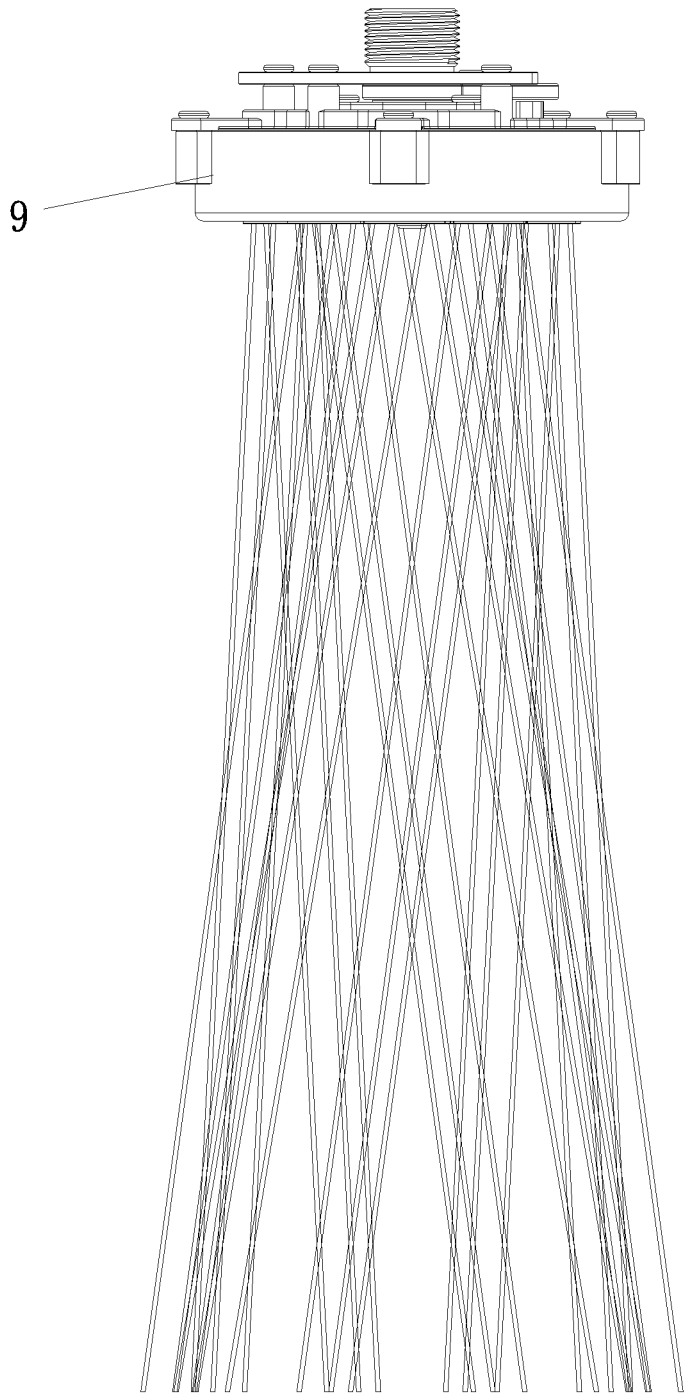
FIG. 4 is a schematic diagram of a water output device capable of regulating water output spray, in which water is output from the water output panel, according to an embodiment of the present invention.

(2) Secondly, pushing the driving lever 33 to bring the seal plate 3 to rotate, and then bring the rotation panels 91 into rotation, such that the water passage hole 35 is connected to and in communication with the second water input hole. As such, water is output from the water ejection hole 92 of the water output panel 9 as shown in FIG. 4, and the direction of water flow is as shown in FIG. 2.

(3) Thirdly, continuing pushing the driving lever 33, to bring the rotation panels 91 continuously into rotation, such that the connection area between the water passage hole 35 and the second water input hole first increasing and then decreasing. When the driving lever 33 is pushed to rotate to a preset angle, the water passage hole 35 is detached from the second water input hole, so that water is not output from the water ejection holes 92 of the water output panel 9.

Figure 3:
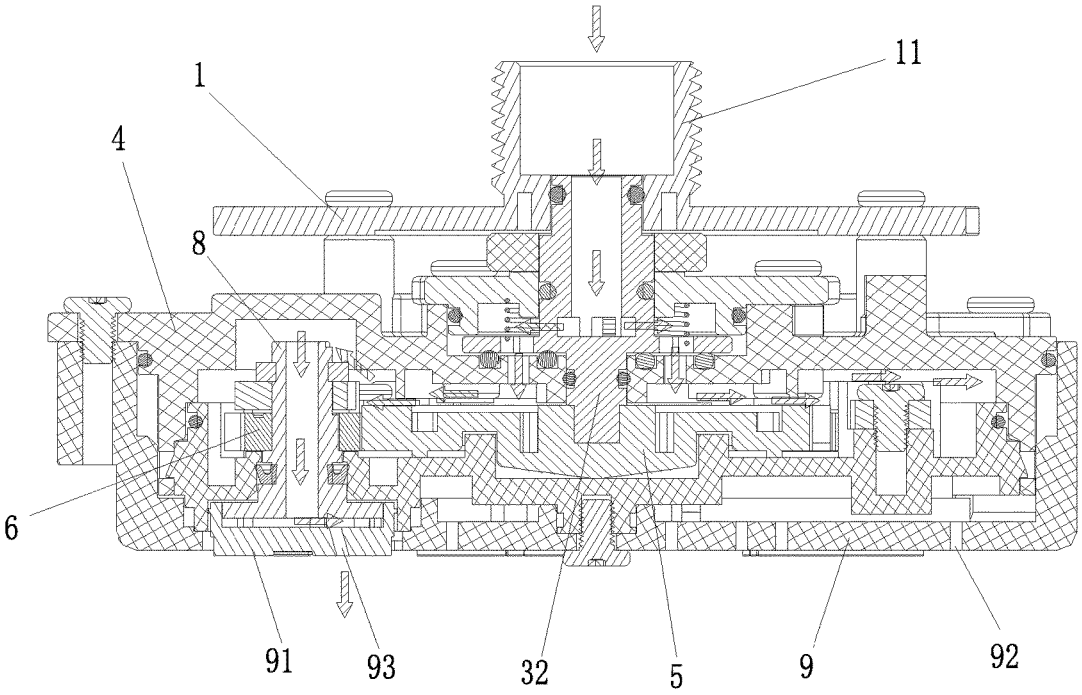
FIG. 3 is a schematic diagram of a water output device capable of regulating water output spray, in which the rotation panel is disposed for outputting water, according to an embodiment of the present invention.
Figure 5:
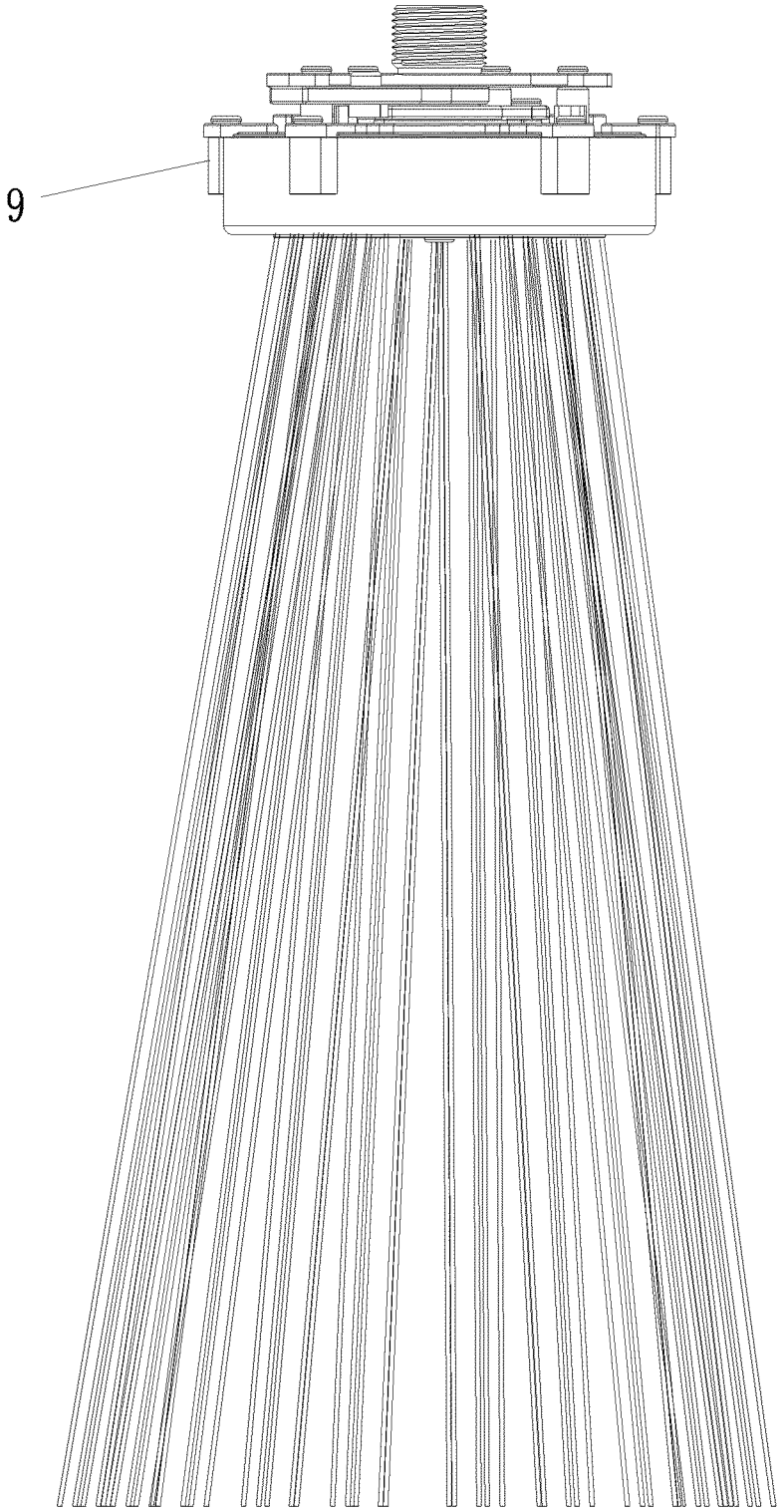
FIG. 5 is a schematic diagram of a water output device capable of regulating water output spray, in which water is output from the rotation panel, according to an embodiment of the present invention.
Figure 6:
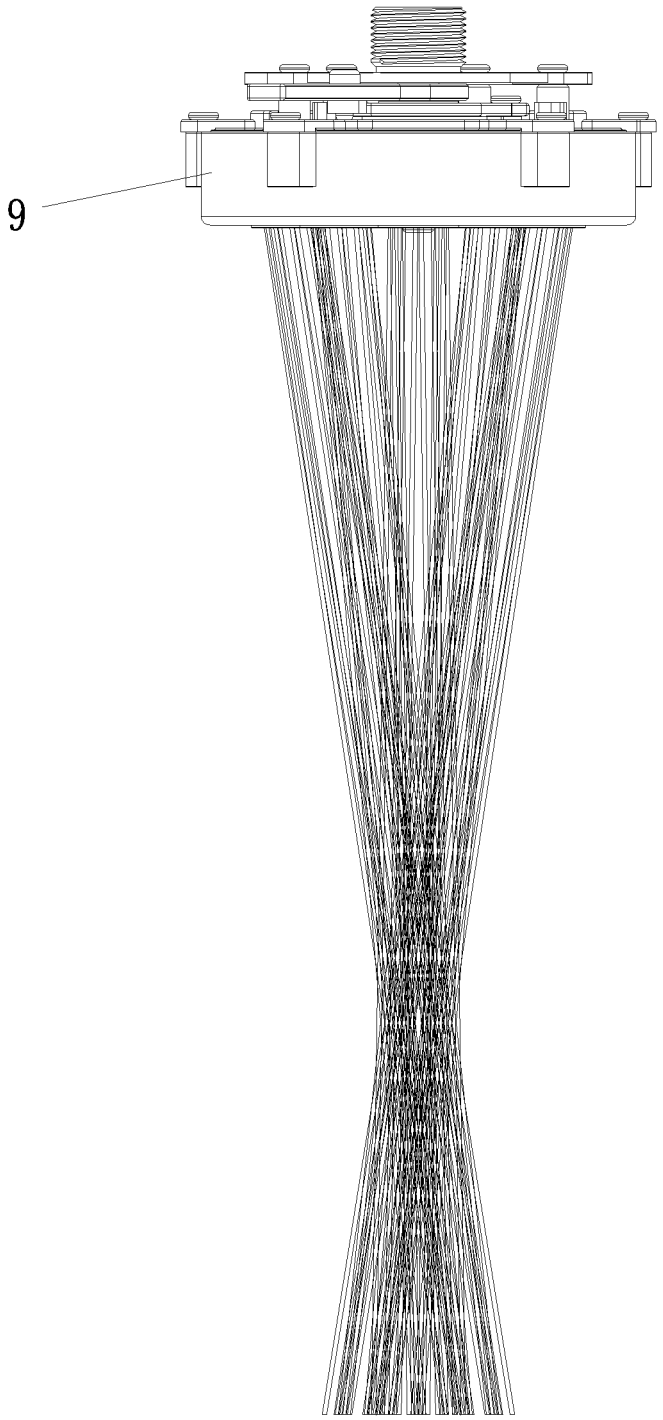
FIG. 6 is a schematic diagram of a water output device capable of regulating water output spray, in which water is output convergently from the rotation panel, according to an embodiment of the present invention.
Figure 7:
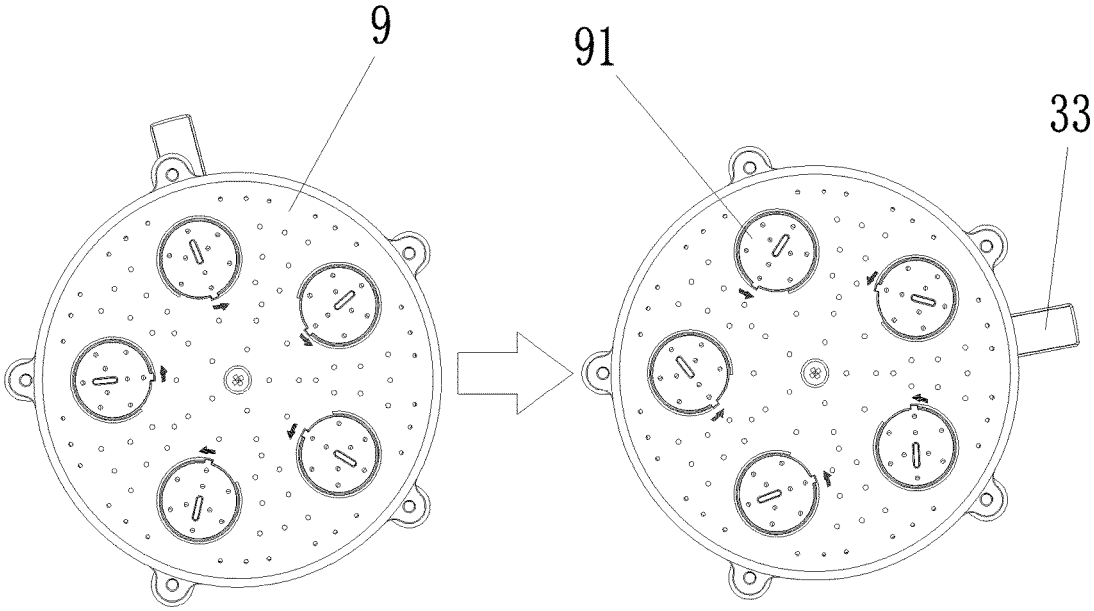
FIG. 7 is a schematic diagram of a rotation panel, in which the rotation panel is shown in different rotation states, according to an embodiment of the present invention.

(4) Finally, continuing pushing the driving lever 33 further, to bring the rotation panel 91 into rotation, such that the water passage hole 35 is connected to and in communication with the first water input hole, and water is output from the slant water output holes 93 of the rotation panel 91. At this time, the shower water ejected from the slant water output holes 93 will turn from ejecting water outward and sideways, to converging water to the line passing through the center of the water output panel 9, as shown in FIGS. 5 and 6, while the direction of the water flow is as shown in FIG. 3.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A water output device capable of regulating water output spray, comprising:

a water channel switching mechanism;

an outer chamber;

an inner chamber, disposed inside the outer chamber;

an upper chamber, used to supply water to the inner chamber and the outer chamber;

a water output panel, disposed on the outer chamber;

a plurality of rotation panels, disposed evenly on the water output panel to form into a ring, on the respective rotation panels is provided with slant water output holes, and water is supplied to the rotation panel from the inner chamber; and a driving mechanism, disposed in the inner chamber, to drive all the rotation panels into rotation synchronously, wherein the driving mechanism includes a sun gear disposed in a center of the inner chamber, and a planetary gear disposed fixedly on a side wall of the rotation shaft engaging the sun gear;

wherein the water channel switching mechanism includes a seal plate separating the upper chamber into an upper part and a lower part; on the seal plate is provided with a water passage hole; on a lower surface of the seal plate is provided with a lug penetrating through the upper chamber for controlling rotation of the sun gear; on an upper surface of the seal plate is provided with a water input tube; on a bottom portion of a side wall of the water input tube is provided with a water output port; an upper end of the water input tube penetrating through a water seal seat is connected to the water supply pipe line; while a driving lever is sleeved around an upper end of the water input tube, for driving the water input tube into rotation, such that when the driving lever is moved to drive the seal plate into rotation, the water passage hole is connected to and in communication with the first water input hole and the second water input hole in sequence.

2. The water output device capable of regulating water output spray as claimed in claim 1, wherein the water channel switching mechanism is disposed in the upper chamber to control switching of water supply to the inner chamber and the outer chamber, and when the water channel switching mechanism rotates, it brings the driving mechanism into rotation at the same time.

3. The water output device capable of regulating water output spray as claimed in claim 2, wherein the outer chamber is formed by the water output panel and an upper seat plate;

the inner chamber is formed by a bottom seat and the upper seat plate;

the upper chamber is formed by a water seal seat and the upper seat plate;

in the inner chamber is disposed evenly a plurality of rotation shafts formed into a ring, in the respective rotation shaft is provided with a through hole;

an upper end of the through hole is connected and in communication with the inner chamber, a lower end of the through hole is connected to the rotation panel, to rotate synchronously with the rotation panel;

the driving mechanism drives all the rotation shafts into rotation synchronously;

in the upper chamber is provided with a first water input hole connected to and in communication with the inner chamber, and second water input hole connected to and in communication with the outer chamber; and the water channel switching mechanism is connected to a water supply pipe line, and when the water channel switching mechanism rotates, it controls and brings the first water input hole and the second water input hole to connect to and in communication respectively with the water supply pipe line.

4. The water output device capable of regulating water output spray as claimed in claim 1, further comprising:

an upper cover, disposed above the driving lever; and a threaded pipe, disposed on the upper cover and is connected to and in communication with the water supply pipe line, and an input port of the water input tube is connected to the threaded pipe.

5. The water output device capable of regulating water output spray as claimed in claim 4, further comprising:

a ring shape fixing frame, hinged to the rotation shaft, on the ring shape fixing frame is provided with a plurality of hinge holes having the same quantity as that of the rotation shaft.

6. The water output device capable of regulating water output spray as claimed in claim 5, further comprising:

a plurality of tight seal rings, disposed respectively between the water output panel and the upper seat plate, the bottom seat and the upper seat plate, the water seal seat and the upper seat plate, the lug and the upper seat plate, and around perimeters of the first water input hole and the second water input hole.

7. The water output device capable of regulating water output spray as claimed in claim 6, further comprising:

a gag lever rod, disposed in a center at a bottom portion of the driving lever.

* * * * *